US008746919B2

(12) United States Patent
Noguchi et al.

(10) Patent No.: US 8,746,919 B2
(45) Date of Patent: Jun. 10, 2014

(54) LUMINAIRE CONTROLLING A LUMINOUS INTENSITY DISTRIBUTION

(75) Inventors: Yoko Noguchi, Yokosuka (JP); Tomoko Ishiwata, Yokosuka (JP); Kazunori Yashiro, Yokosuka (JP); Masaru Inoue, Yokosuka (JP); Makoto Kawagoe, Yokosuka (JP); Fumie Iwata, Yokosuka (JP); Hitoshi Kawano, Yokosuka (JP); Shigehisa Kawatsuru, Yokosuka (JP)

(73) Assignee: Toshiba Lighting & Technology Corporation, Kanagawa-Ken (JP)

( * ) Notice: Subject to any disclaimer, the term of this patent is extended or adjusted under 35 U.S.C. 154(b) by 0 days.

(21) Appl. No.: 13/530,551

(22) Filed: Jun. 22, 2012

(65) Prior Publication Data

US 2013/0250554 A1 Sep. 26, 2013

(30) Foreign Application Priority Data

Mar. 26, 2012 (JP) ..... 2012-070446

(51) Int. Cl.
*F21S 8/00* (2006.01)
*F21V 13/10* (2006.01)

(52) U.S. Cl.
USPC ..... 362/147; 362/539

(58) Field of Classification Search
CPC ..... F21V 13/04; F21V 21/03; F21V 5/04; G01F 1/133308; H01L 33/60
USPC ..... 362/249.02, 147, 217.05, 404; 313/498, 313/512
See application file for complete search history.

(56) References Cited

U.S. PATENT DOCUMENTS

| | | | | |
|---|---|---|---|---|
| 6,871,983 | B2 * | 3/2005 | Jacob et al. | 362/364 |
| 7,246,924 | B2 * | 7/2007 | Pfund | 362/325 |
| 2010/0195322 | A1 * | 8/2010 | Kawakami et al. | 362/231 |

FOREIGN PATENT DOCUMENTS

| | | |
|---|---|---|
| JP | 2009-054989 | 3/2009 |

* cited by examiner

*Primary Examiner* — Tracie Y Green
(74) *Attorney, Agent, or Firm* — Patterson & Sheridan, LLP

(57) ABSTRACT

According to one embodiment, a luminaire is provided which can enhance the feeling of brightness of a space and can reduce glare. The luminaire includes an equipment mounted on a ceiling surface. The equipment includes a light source and a light control unit. When an amount of light emitted outside from the equipment is an equipment luminous flux, and a direction right under the equipment has a luminous intensity distribution angle of 0°, the light control unit controls to cause a luminous flux falling within a range of a luminous intensity distribution angle of 90° to 120° to be 20% or more of the equipment luminous flux and to cause a luminous flux falling within a range of a luminous intensity distribution angle of 60° to 90° to be 20% or less of the equipment luminous flux.

14 Claims, 5 Drawing Sheets

LUMINAIRE CONTROLLING A LUMINOUS INTENSITY DISTRIBUTION

INCORPORATION BY REFERENCE

The present invention claims priority under 35 U.S.C. §119 to Japanese Patent Application No. 2012-070446 filed on Mar. 26, 2012. The content of the application is incorporated herein by reference in their entirety.

FIELD

Embodiments described herein relate generally to a luminaire mounted on a ceiling surface.

BACKGROUND

Hitherto, as a luminaire mounted on a ceiling surface, there is a luminaire in which straight tube type LED lamps are arranged on both sides of an inverted mount shaped reflecting plate. In this luminaire, since the light from the straight tube type LED lamps is reflected by the reflecting surface and is irradiated to the ceiling surface, the ceiling surface becomes bright and the feeling of brightness of the space is obtained.

Besides, as a luminaire mounted on a ceiling surface, there is a luminaire including LED elements. In this luminaire, the plural LED elements are arranged in an equipment, and the light emitted from the LED elements is emitted downward from the lower surface of the equipment. Since this luminaire can be made thin, the sense of oppression in the space is reduced, and the sense of unity with the ceiling surface can be produced.

In the luminaire using the straight tube type LED lamp, the ceiling surface becomes bright, and the feeling of brightness of the space is obtained. However, the light of the exposed straight tube type LED lamps is apt to be so bright as to cause an unpleasant glare. Besides, in the luminaire including the LED elements, since the light is emitted downward from the lower surface of the equipment, the light is not irradiated to the ceiling surface, the ceiling surface becomes dark, and the feeling of brightness of the space is hard to be obtained.

According to an exemplary embodiment described herein, a luminaire is provided which can enhance the feeling of brightness of the space and can reduce the glare.

DETAILED DESCRIPTION

In general, according to one embodiment, a luminaire includes an equipment mounted on a ceiling surface. The equipment includes a light source and a light control unit. When an amount of light emitted outside from the equipment is an equipment luminous flux, and a direction right under the equipment has a luminous intensity distribution angle of 0°, the light control unit controls to cause a luminous flux falling within a range of a luminous intensity distribution angle of 90° to 120° to be 20% or more of the equipment luminous flux and to cause a luminous flux falling within a range of a luminous intensity distribution angle of 60° to 90° to be 20% or less of the equipment luminous flux.

According to this structure, since the luminous flux falling within the range of a luminous intensity distribution angle of 90° to 120° is 20% or more of the equipment luminous flux, and the luminous flux falling within the range of a luminous intensity distribution angle of 60° to 90° is 20% or less of the equipment luminous flux, the luminaire is provided which can enhance the feeling of brightness of the space and can reduce the glare.

Hereinafter, an embodiment will be described with reference to FIG. 1 to FIG. 7.

Figure 1:
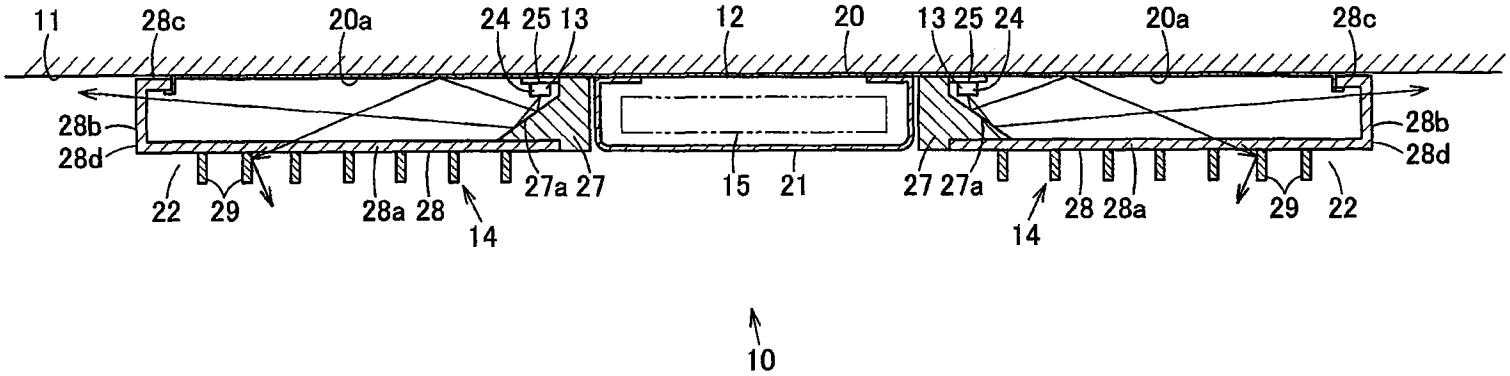
FIG. 1 is a sectional view of a luminaire of an embodiment.

In FIG. 1, a luminaire 10 is a ceiling mounting type luminaire directly mounted on a ceiling surface 11. The luminaire 10 includes an equipment 12 mounted on the ceiling surface 11, a light source 13 to emit light, a light control unit 14 to control a luminous intensity distribution, and a lighting device 15 to light the light source 13.

The equipment 12 includes a main body 20 having a rectangular plate shape. The main body 20 is attached with a case 21 at the center in a short side direction perpendicular to a long side direction of the main body 20, and is provided with light-emitting parts 22 at both sides of the case 21. The case 21 and the light-emitting parts 22 are continuously provided along the long side direction of the main body 20. The lighting device 15 is disposed inside the case 21, and the light source 13 and the light control unit 14 are disposed in each of the light-emitting parts 22. A reflecting surface 20*a* as a white surface or a mirror surface is formed on the lower surface of the main body 20 in each of the light-emitting parts 22.

An LED element 24 as a semiconductor light-emitting element is used for the light source 13. The LED element 24 is mounted on a board 25, and the board 25 is attached to the lower surface of the main body 20 in a state where an outgoing surface to emit light from the LED element 24 is directed downward.

The light control unit 14 includes a reflector 27, a translucent cover 28 and plural louvers 29.

The reflector 27 includes a reflecting surface 27*a* obliquely facing the outgoing surface of the LED element 24. The reflecting surface 27*a* reflects the light emitted from the LED element 24 toward the range extending from the reflecting surface 20*a* of the main body 20 to the side surface of the translucent cover 28.

The translucent cover 28 is formed of a material having transparency or milky translucency, and includes a lower surface part 28*a*, a side surface part 28*b* and an upper surface part 28*c*. The lower surface part 28*a* is attached to the reflector 27, and the upper surface part 28*c* is attached to a side edge of the main body 20. The translucent cover 28 covers the light-emitting part 22 of the equipment 12, and the surface of the translucent cover 28 is a light-emitting surface 28*d*.

The plural louvers 29 are formed of a material having a light shielding property, and the surfaces are formed to be reflecting surfaces as white surfaces. The plural louvers 29 are attached to the lower surface part 28*a* of the translucent cover 28 at specified intervals, and protrude downward from the lower surface part 28*a* of the translucent cover 28.

In the luminaire 10, the LED element 24 is turned on, and the light is emitted from the light-emitting part 22. That is, the light from the LED element 24 is reflected by the reflecting surface 27*a* of the reflector 27 toward the side surface part 28*b* of the translucent cover 28 and the reflecting surface 20*a* of the main body 20. The light directed toward the side surface part 28*b* of the translucent cover 28 is emitted toward the side of the luminaire 10 and the ceiling surface 11 through the side surface part 28*b* of the translucent cover 28. The light directed toward the reflecting surface 20*a* of the main body 20 is reflected by the reflecting surface 20*a*, passes through the lower surface part 28*a* of the translucent cover 28, and is emitted downward through the space between the louvers 29. The light incident on the surface of the louver 29 is reflected by the louver 29 and is directed downward.

Accordingly, the reflector 27, the translucent cover 28, the plural louvers 29 and the reflecting surface 20*a* of the main body 20 constitute the light control unit 14 to control the luminous intensity distribution of the light emitted from the equipment 12.

Figure 2:
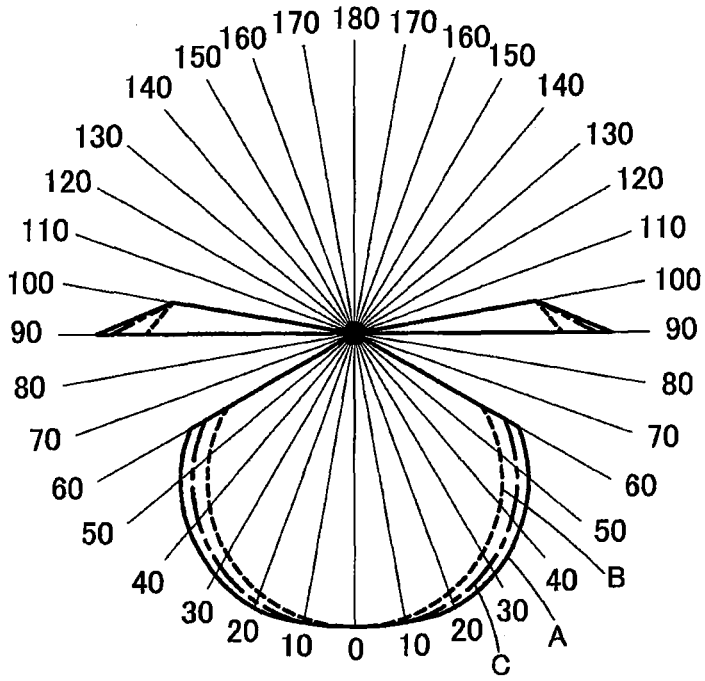
FIG. 2 is a luminous intensity distribution view of the luminaire.

The luminaire 10 including the light control unit 14 has a luminous intensity distribution characteristic shown in the luminous intensity distribution view of FIG. 2. A luminous intensity distribution curve A represents a luminous intensity distribution in a long side direction A-A of the luminaire 10 shown in FIG. 4, a luminous intensity distribution curve B represents a luminous intensity distribution in a short side direction B-B of the luminaire 10 shown in FIG. 4, and a luminous intensity distribution curve C represents a luminous intensity distribution in a direction C-C inclined by 45° with respect to the long side direction and the short side direction of the luminaire 10 shown in FIG. 4. Besides, the amount of light emitted outside from the equipment 12 is an equipment luminous flux, and a direction right under the equipment 12 has a luminous intensity distribution angle of 0°.

As shown in FIG. 2, the luminous flux falling within the range of a luminous intensity distribution angle of 90° to 120° is 20% or more of the equipment luminous flux, and the luminous flux falling within the range of a luminous intensity distribution angle of 60° to 90° is 20% or less of the equipment luminous flux. Further, when a luminous flux falling within the range of a luminous intensity distribution angle of 60° to 180° is 100%, 80% or more of the luminous flux falls within the range of a luminous intensity distribution angle of 90° to 110°. The ratio of the luminous flux to the luminous intensity distribution angle is kept in all directions in the horizontal direction of the equipment 12. Besides, a luminous intensity value at a luminous intensity distribution angle of 80° or more and less than 90° is a value satisfying such a condition that a luminous value obtained when the equipment is observed from the range of a luminous intensity distribution angle of 80° or more and less than 90° is less than 7300 cd/m$^2$.

In the case of the luminaire 10 of the embodiment, the luminous intensity distribution as stated above can be realized in such a way that the translucent cover 28 is provided with the side surface part 28*b* through which light can be emitted, the light of the LED element 24 is emitted from the side surface part 28*b* of the translucent cover 28 to the ceiling surface 11 by the reflecting surface 27*a* of the reflector 27, and the light traveling in an oblique direction (luminous intensity distribution angle of 60° to 90°) is shielded by the louvers 29.

Figure 3:
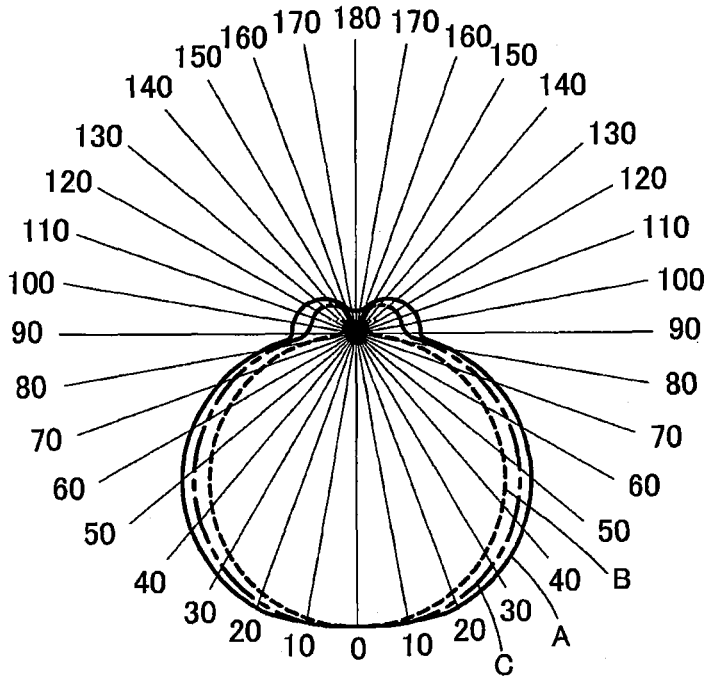
FIG. 3 is a luminous intensity distribution view of a related art luminaire.
Figure 4:
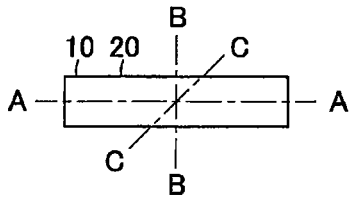
FIG. 4 is an explanatory view for explaining a luminous intensity distribution direction of a luminaire.

Incidentally, FIG. 3 is a luminous intensity distribution view of a related art luminaire including an LED element. In the related art luminaire, light from the LED element is emitted downward from the lower surface of the equipment. Thus, the luminous flux at a luminous intensity distribution angle of 90° or more is low, and the luminous flux at a luminous intensity distribution angle of 60° to 90° is high.

Here, a work surface illuminance, an indirect illuminance at an eye position, and a UGR (Unified Glare Rating) value are compared between the luminaire 10 of the embodiment and the related art luminaire.

Figure 5:
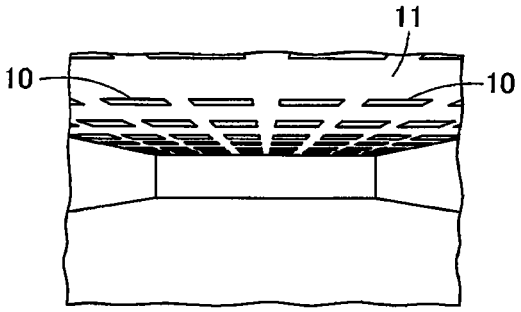
FIG. 5 is a perspective view of a space in which a luminaire is installed.

As shown in FIG. 5, for example, the respective luminaires are mounted on the ceiling surface 11 of the space in an office or the like, and the respective comparison items are measured under the same condition. The space measures 14.4 meters by 14.4 meters by 2.8 meters high. The reflectance of the ceiling surface 11 is 70%, the reflectance of a wall surface is 50%, and the reflectance of a floor surface is 10%. In the respective luminaires, the equipment luminous flux is 6300 lm, the number of equipments is 64, the interval between the equipments is 1.8 m.

As the work surface illuminance, the illuminance at a height of 0.8 m from the floor surface was measured. As a result of the measurement, the work surface illuminance of the related art luminaire was 473 lx, and the work surface illuminance of the luminaire 10 of the embodiment was 500 lx. The work surface illuminance of the luminaire 10 of the embodiment was enhanced by 5%. This is because the light traveling in the direction of a luminous intensity distribution angle of 60° to 90° is reflected downward by the louvers 29.

The indirect illuminance at the eye position is an index of the feeling of brightness of the space, and the indirect illuminance on the vertical surface at the center of the frontage of the space and at the position of a depth of 0 m and a height of 1.2 m from the floor surface was measured. As a result of the measurement, the indirect illuminance at the eye position of the related art luminaire was 68 lx, and the indirect illuminance at the eye position of the luminaire 10 of the embodiment was 100 lx. The feeling of brightness of the space according to the luminaire 10 of the embodiment was enhanced by 47%. This is because the luminous flux falling within the range of a luminous intensity distribution angle of 90° to 120° is 20% or more of the equipment luminous flux, and further, when the luminous flux falling within the range of a luminous intensity distribution angle of 60° to 180° is 100%, 80% or more of the luminous flux falls within the range of a luminous intensity distribution angle of 90° to 110°, so that the brightness of the ceiling surface 11 is enhanced. In the luminaire 10 of the embodiment, when the work surface illuminance at the height of 0.7 to 0.85 m from the floor surface is 400 to 700 lx, the indirect illuminance on the vertical surface at the height of 1.2 m from the floor surface is 70 lx or more. Thus, the feeling of brightness of the space can be enhanced as compared with the related art.

With respect to the UGR value, the UGR value of the related art luminaire was 28, and the UGR value of the luminaire 10 of the embodiment was 22. The UGR value of the luminaire 10 of the embodiment was reduced by 6%, and the glare was reduced. This is because the light traveling in the direction of an luminous intensity distribution angle of 60° to 90° is shielded by the louvers 29, the luminous flux falling within the range of a luminous intensity distribution angle of 60° to 90° is 20% or less of the equipment luminous flux, and further, when the luminous flux falling within the range of a luminous intensity distribution angle of 60° to 180° is 100%, 80% or more of the luminous flux falls within the range of a luminous intensity distribution angle of 90° to 110°, so that the light traveling in the direction of a luminous intensity distribution angle of 60° to 90° is low. In the luminaire 10 of the embodiment, even when the work surface illuminance is 650 to 1000 lx, since the UGR value can be made less than 25, the glare can be reduced.

Besides, in the luminaire 10 of the embodiment, the luminance value obtained when the equipment 12 was observed in the range of a luminous intensity distribution angle of 80° or more and less than 90° was 6874 cd/m$^2$.

As stated above, in the luminaire 10 of the embodiment, the luminous flux falling within the range of a luminous intensity distribution angle of 90° to 120° is 20% or more of the equipment luminous flux, and the luminous flux falling within the range of a luminous intensity distribution angle of 60° to 90° is 20% or less of the equipment luminous flux. Accordingly, the feeling of brightness of the space can be enhanced, and the glare can be reduced.

Further, in the luminaire 10 of the embodiment, when the luminous flux falling within the range of a luminous intensity distribution angle of 60° to 180° is 100%, 80% or more of the luminous flux falls within the range of a luminous intensity distribution angle of 90° to 110°. Accordingly, the feeling of brightness of the space can be enhanced, and the glare can be reduced.

Besides, since the luminous intensity value in a luminous intensity distribution angle of 80° or more and less than 90° satisfies such a condition that the luminance value obtained when the equipment 12 is observed in the range of a luminous intensity distribution angle of 80° or more and less than 90° is less than 7300 cd/m$^2$, the glare can be reduced.

Besides, since the ratio of the luminous flux to the luminous intensity distribution angle in all directions in the horizontal direction of the equipment 12 is kept, the feeling of brightness of the space can be enhanced at any point in the space, and the glare can be reduced.

Besides, when the work surface illuminance at the height of 0.7 to 0.85 m from the floor surface is 400 to 700 lx, since the indirect illuminance on the vertical surface at the height of 1.2 m from the floor surface is 70 lx or more, the feeling of brightness of the space can be enhanced as compared with the related art.

Besides, even when the work surface illuminance is 650 to 1000 lx, the UGR value is made less than 25, and the glare can be reduced.

Besides, the luminous intensity value at a luminous intensity distribution angle of 80° or more and less than 90° satisfies such a condition that the luminance value obtained when the equipment 12 is observed in the range of a luminous intensity distribution angle of 80° or more and less than 90° is less than 7300 cd/m$^2$, that is, the luminance characteristic of G1b classification of glare stipulated in illumination design can be satisfied.

With respect to the indirect illuminance at the eye position, the relation to the luminous intensity distribution angle, and the relation to the distance from the ceiling surface 11 to the light-emitting surface 28*d* were measured.

Figure 6:
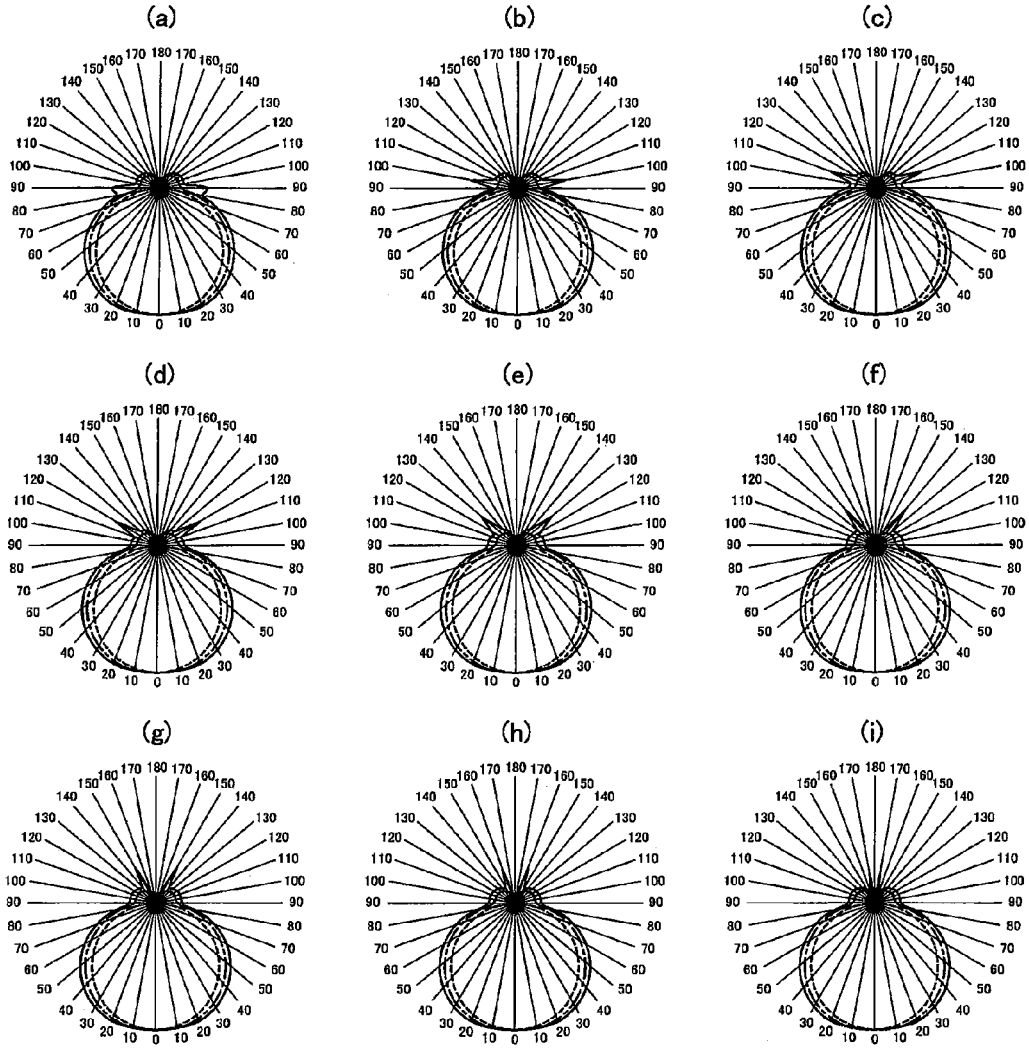
FIGS. 6(*a*) to 6(*i*) are luminous intensity distribution views of a case where a maximum luminous intensity value is changed at every 10° within a range of a luminous intensity distribution angle of 90° to 170°.
Figure 7:
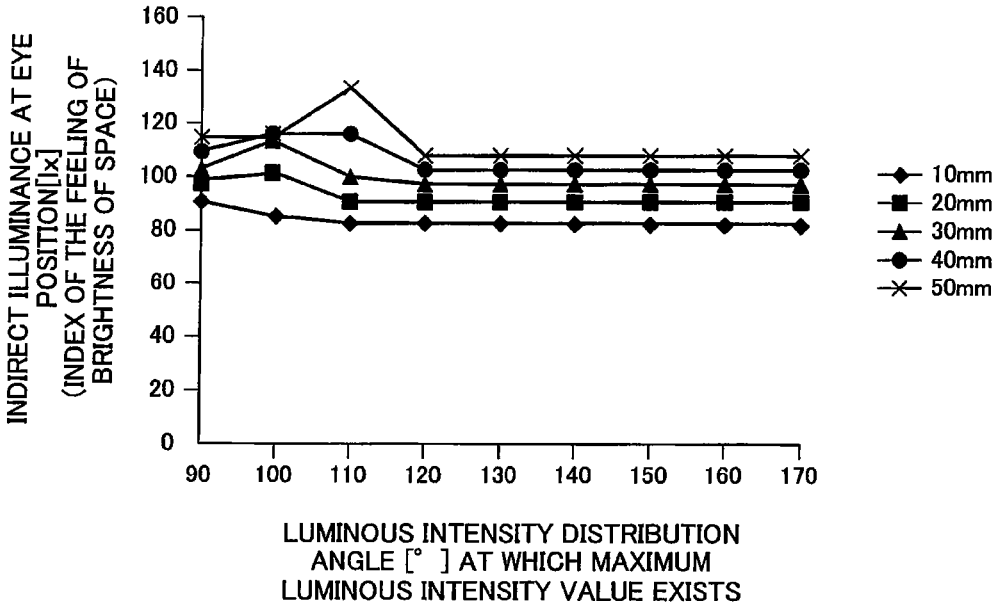
FIG. 7 is a graph showing indirect illuminance at an eye position (index of the feeling of brightness of a space) of a case where a maximum luminous intensity value is changed at every 10° within a range of a luminous intensity distribution angle of 90° to 170° and a distance from a ceiling surface to a light-emitting surface is changed at every 10 mm.

FIG. 6(*a*) to FIG. 6(*i*) are luminous intensity distribution views of the case where the maximum luminous intensity value is changed at every 10° in the range of a luminous intensity distribution angle of 90° to 170°. FIG. 7 is a graph of the indirect illuminance at the eye position (index of the feeling of brightness of the space) in the case where the maximum luminous intensity value is changed at every 10° in the range of a luminous intensity distribution angle of 90° to 170° and the distance from the ceiling surface 11 to the light emitting surface 28*d* is changed at every 10 mm.

Incidentally, since the measurement is made while the maximum luminous intensity value is changed at every 10° in the range of a luminous intensity distribution angle of 90° 170°, the luminaire used in the measurement has a structure different from the structure shown in FIG. 1. Thus, the luminous intensity distribution characteristics shown in FIG. 6(*a*) to FIG. 6(*i*) are different from the luminous intensity distribution characteristic shown in FIG. 2.

As a result of the measurement, in the range of a luminous intensity distribution angle of 90° to 170°, since the maximum luminous intensity value existed at a luminous intensity distribution angle of 90° to 120°, the indirect illuminance at the eye position was enhanced. On the other hand, it was found that a luminous intensity distribution angle of 125° or more was irrelevant to the improvement of the indirect illuminance at the eye position.

Further, when the distance from the ceiling surface 11 to the light-emitting surface 28*d* was 10 mm, the indirect illuminance at the eye position became maximum at a luminous intensity distribution angle of 90°. When the distance from the ceiling surface 11 to the light-emitting surface 28*d* was 20 to 40 mm, the indirect illuminance at the eye position became maximum at a luminous intensity distribution angle of 100°. When the distance from the ceiling surface 11 to the light-emitting surface 28*d* was 50 mm, the indirect illuminance at the eye position became maximum at a luminous intensity distribution angle of 110°.

From these, when the distance from the ceiling surface 11 to the light-emitting surface 28*d* is 10 mm or less, the maximum luminous intensity value among the luminous intensity values in the range of a luminous intensity distribution angle of 90° to 120° is in the range of a luminous intensity distribution angle of 90° to 100°, and the feeling of brightness of the space can be enhanced.

When the distance from the ceiling surface 11 to the light-emitting surface 28*d* is 10 mm or more and less than 50 mm, the maximum luminous intensity value among the luminous intensity values in the range of a luminous intensity distribution angle of 90° to 120° is in the range of a luminous intensity distribution angle of 95° to 110°, and the feeling of brightness of the space can be enhanced.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. A luminaire comprising:

an equipment mounted on a ceiling surface;

a light source installed in the equipment; and a light control unit having a reflection unit or a shielding unit that causes a luminous flux included within a range of a luminous intensity distribution angle of 90° to 120° to be 20% or more of an equipment luminous flux and a luminous flux included within a range of a luminous intensity distribution angle of 60° to 90° to be 20% or less of the equipment luminous flux, where the equipment luminous flux is a measure of an amount of light emitted from the equipment to the outside and a direction directly underneath the equipment has a luminous intensity distribution angle of 0°.

2. The luminaire of claim 1, wherein an illuminance of a work space at a height of 0.7 to 0.85 m from a floor surface is 400 to 700 lux (lx) if the equipment is mounted on a ceiling surface at a height of 2.8 m, and an indirect illuminance on a vertical surface at a height of 1.2 m from the floor surface is 70 lx or more.

3. The luminaire of claim 1, wherein a UGR value of less than 25 is obtained if a work surface illuminance is to be 650 to 1000 lx.

4. The luminaire of claim 1, wherein the reflection unit or shielding unit of the light control unit causes a luminous intensity value at a luminous intensity distribution angle of 80° or more and less than 90° to satisfy a condition that a luminance value of the equipment in a range of a luminous intensity distribution angle of 80° or more and less than 90° is less than 7300 cd/m$^2$.

5. The luminaire of claim 1, wherein the equipment includes a light-emitting surface to emit light, and the reflection unit or the shielding unit of the light control unit causes a maximum luminous intensity value among luminous intensity values in a range of a luminous intensity distribution angle of 90° to 120° to be in a range of a luminous intensity distribution angle of 90° to 100° if a distance from the ceiling surface to the light-emitting surface is 10 mm less.

6. The luminaire of claim 1, wherein the equipment includes a light-emitting surface to emit light, and the reflection unit or the shielding unit of the light control unit causes a maximum luminous intensity value among luminous intensity values in a range of a luminous intensity distribution angle of 90° to 120° to be in a range of a luminous intensity distribution angle of 95° to 110° if a distance from the ceiling surface to the light-emitting surface is 10 mm or more and less that 50 mm.

7. The luminaire of claim 1, wherein the light control unit includes a reflector as the reflection unit to cause light to be emitted at a luminous intensity distribution angle of 90° to 120°, and a louver as the shielding unit to shield light traveling in a direction of a luminous intensity distribution angle of 60° to 90°.

8. The luminaire of claim 1, wherein the light source is an LED element.

9. A luminaire comprising:

an equipment mounted on a ceiling surface;

a light source installed in the equipment; and a light control unit having a reflection unit or shielding unit that causes 80% or more of the luminous flux to fall within a range of a luminous intensity distribution angle of 90° to 110° if a luminous flux included within a range of a luminous intensity distribution angle of 60° to 180° is 100%.

10. The luminaire of claim 9, wherein the light control unit includes a reflector as the reflection unit, louvers as the shielding unit, and a translucent cover on which the louvers are mounted.

11. A luminaire comprising:

an equipment mounted on a ceiling surface;

a light source installed in the equipment; and a light control unit including reflectors to cause light to be emitted at a luminous intensity distribution angle of 90° to 120°, and louvers to shield light traveling in a direction of a luminous intensity distribution angle of 60° to 90°.

12. The luminaire of claim 11, wherein the light control unit further includes a translucent cover on which the louvers are mounted, and the louvers are arranged on the translucent cover such that a luminous flux falling within a range of a luminous intensity distribution angle of 60° to 90° is 20% or less of an equipment luminous flux, which is a measure of an amount of light emitted from the equipment to the outside.

13. The luminaire of claim 12, wherein the reflectors are arranged inside the translucent cover such that a luminous flux falling within a range of a luminous intensity distribution angle of 90° to 120° is 20% or more of the equipment luminous flux.

14. The luminaire of claim 13, wherein the reflectors and the louvers are arranged such that a luminous intensity value at a luminous intensity distribution angle of 80° or more and less than 90° satisfies a condition that a luminance value of the equipment in a range of a luminous intensity distribution angle of 80° or more and less than 90° is less than 7300 cd/m$^2$.

* * * * *